US009751302B1

(12) United States Patent
Nishimura et al.

(10) Patent No.: US 9,751,302 B1
(45) Date of Patent: Sep. 5, 2017

(54) MITIGATING EFFECTS OF CROSSTALK IN AN INKJET HEAD

(71) Applicants: Hiroshi Nishimura, West Hills, CA (US); Shogo Nobumori, Thousand Oaks, CA (US)

(72) Inventors: Hiroshi Nishimura, West Hills, CA (US); Shogo Nobumori, Thousand Oaks, CA (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/058,085

(22) Filed: Mar. 1, 2016

(51) Int. Cl.
*B41J 2/045* (2006.01)

(52) U.S. Cl.
CPC ..... *B41J 2/04525* (2013.01)

(58) Field of Classification Search
CPC ..... B41J 2/04525
See application file for complete search history.

(56) References Cited

U.S. PATENT DOCUMENTS 6,328,397 B1 * 12/2001 Shimizu ..... B41J 2/04508 347/10
6,719,390 B1 * 4/2004 Howkins ..... B41J 2/04525 347/12
8,278,976 B2 10/2012 Yu et al.
2011/0063350 A1 * 3/2011 Kusunoki ..... B41J 2/04525 347/11

* cited by examiner

*Primary Examiner* — Alessandro Amari
*Assistant Examiner* — Roger W Pisha, II
(74) *Attorney, Agent, or Firm* — Duft Bornsen & Fettig LLP

(57) ABSTRACT

Systems and methods of mitigating the effects of crosstalk in an inkjet head. An inkjet head has ink channels that jet droplets of a liquid material using piezoelectric actuators. Drive waveforms provided to the piezoelectric actuators include jetting pulses that cause activation of the piezoelectric actuators to jet the droplets from the ink channels. When crosstalk exists between the ink channels of the inkjet head due to the piezoelectric actuators, the amplitude of the jetting pulses are modified to mitigate the crosstalk between the ink channels.

19 Claims, 7 Drawing Sheets

MITIGATING EFFECTS OF CROSSTALK IN AN INKJET HEAD

FIELD OF THE INVENTION

The following disclosure relates to the field of printing, and in particular, to inkjet heads used in printing.

BACKGROUND

Inkjet printing is a type of printing that propels drops of ink (also referred to as droplets) onto a medium, such as paper, a substrate for 3D printing, etc. The core of an inkjet printer includes one or more print heads (referred to herein as inkjet heads) having multiple ink channels arranged in parallel to discharge droplets of ink. A typical ink channel includes a nozzle, a chamber, and a mechanism for ejecting the ink from the chamber and through the nozzle, which is typically a piezoelectric actuator connected to a diaphragm. To discharge a droplet from an ink channel, a drive circuit provides a drive waveform to the piezoelectric actuator of the ink channel that includes a jetting pulse. In response to the jetting pulse, the piezoelectric actuator generates pressure oscillations inside of the ink channel to push the droplet out of the nozzle. The drive waveforms provided to individual piezoelectric actuators control how droplets are ejected from each of the ink channels.

In an attempt to reduce the size of inkjet heads, the ink channels within the inkjet heads are moved closer together. Also, Drop on Demand (DoD) printing is moving towards higher productivity and quality, which requires small droplet sizes ejected at high jetting frequencies. The print quality delivered by an inkjet head depends on ejection or jetting characteristics, such as droplet velocity, droplet mass (or volume/diameter), jetting direction, etc. The performance of inkjet heads may be hindered by residual vibrations and crosstalk within the inkjet head. Crosstalk is a phenomenon where a jetting of a droplet in one ink channel creates an undesired effect in another ink channel. Crosstalk between ink channels may create variations in the jetting characteristics of the ink channels. For example, crosstalk may cause the droplet mass or droplet velocity to be decreased from a normal case (i.e., where there is no crosstalk). It is therefore desirable to mitigate the effects of crosstalk in an inkjet head to achieve high quality printing.

SUMMARY

Embodiments described herein mitigate the effects of crosstalk in an inkjet head by modifying the drive waveforms supplied to the ink channels. The drive waveforms are pulse waveforms, where a piezoelectric actuator will actuate or "fire" on a pulse to jet a droplet of ink from its corresponding nozzle. In a scenario of negative crosstalk, for example, the drive waveforms may be modified to overshoot the target firing amplitude on a pulse. A pulse applied to piezoelectric actuators with a higher amplitude increases droplet velocity and weight to mitigate the effects of negative crosstalk. In a scenario of positive crosstalk, the drive waveforms may be modified to be lower than the target firing amplitude on a pulse. A pulse applied to piezoelectric actuators with a lower amplitude decreases droplet velocity and weight to mitigate the effects of positive crosstalk. The modification of the waveforms in this manner acts to mitigate the effects of crosstalk in the inkjet head.

In one embodiment, a system includes an inkjet head comprising a plurality of ink channels that jet droplets of a liquid material onto a medium using piezoelectric actuators. The system also includes a jetting pulse generator that provides drive waveforms to the piezoelectric actuators, where the drive waveforms include jetting pulses that cause activation of the piezoelectric actuators to jet the droplets from the ink channels. The system also includes a compensation controller that, responsive to crosstalk between the ink channels in the inkjet head due to the piezoelectric actuators, modifies an amplitude of the jetting pulses provided to the piezoelectric actuators to mitigate the crosstalk between the ink channels.

In another embodiment, the compensation controller increases the amplitude of the jetting pulses responsive to negative crosstalk between the ink channels.

In another embodiment, the compensation controller adjusts a leading edge of the jetting pulses to exceed a target jetting voltage.

In another embodiment, the compensation controller decreases the amplitude of the jetting pulses responsive to positive crosstalk between the ink channels.

In another embodiment, the compensation controller adjusts a leading edge of the jetting pulses below a target jetting voltage.

In another embodiment, the system includes a droplet analyzer that identifies the crosstalk between the ink channels in the inkjet head. The jetting pulse generator provides the drive waveforms to the piezoelectric actuators in adjacent ink channels, and the droplet analyzer measures jetting characteristics of the droplets jetted from the adjacent ink channels, and compares the jetting characteristics of the droplets to target characteristics to identify the crosstalk.

In another embodiment, the jetting characteristics comprise a velocity of the droplets.

In another embodiment, the jetting characteristics comprise a mass of the droplets.

Another embodiment comprises a method of mitigating crosstalk in an inkjet head. The method comprises providing drive waveforms to the piezoelectric actuators with a jetting pulse generator, where the drive waveforms include jetting pulses that cause activation of the piezoelectric actuators to jet the droplets from the ink channels. Responsive to crosstalk between the ink channels in the inkjet head due to the piezoelectric actuators, the method includes modifying an amplitude of the jetting pulses provided to the piezoelectric actuators to mitigate the crosstalk between the ink channels.

Another embodiment comprises a drive circuit that connects to an inkjet head having a plurality of ink channels that jets droplets of a liquid material onto a medium using piezoelectric actuators. The drive circuit provides drive waveforms to the piezoelectric actuators, where the drive waveforms include jetting pulses that cause activation of the piezoelectric actuators to jet the droplets from the ink channels. The drive circuit, responsive to the existence of crosstalk between the ink channels in the inkjet head due to the piezoelectric actuators, modifies the jetting pulses of the drive waveforms to increase or decrease an amplitude of the jetting pulses to mitigate effects of the crosstalk.

The above summary provides a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later.

DESCRIPTION OF THE DRAWINGS

Some embodiments of the present disclosure are now described, by way of example only, and with reference to the accompanying drawings. The same reference number represents the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
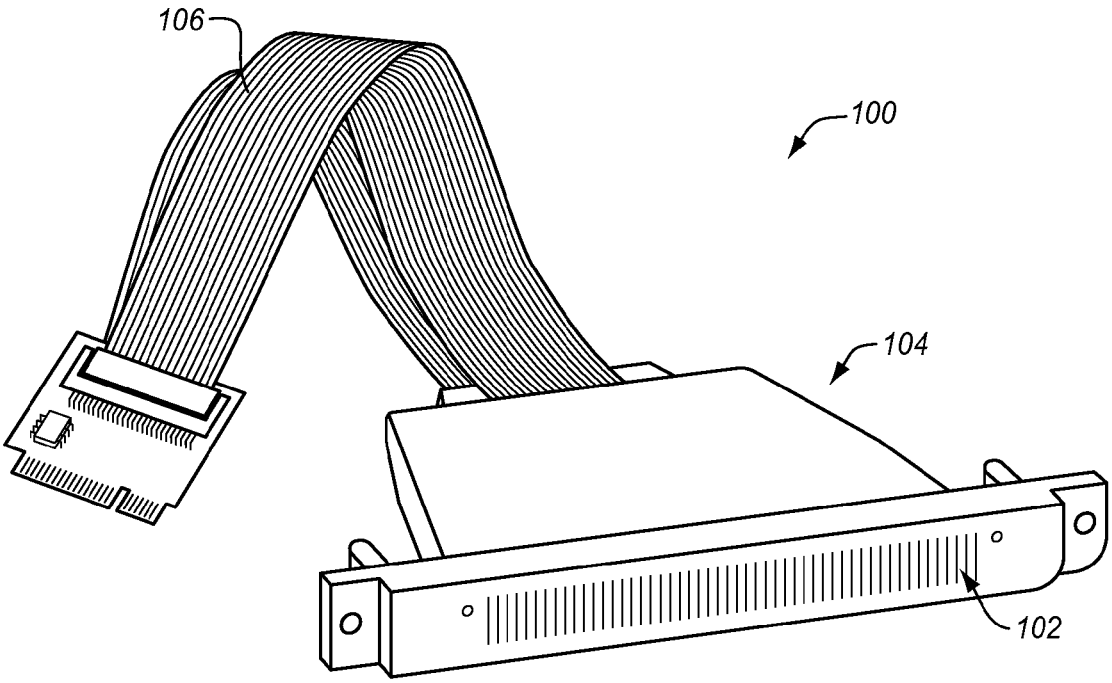
FIG. 1 illustrates an inkjet head.

FIG. 1 illustrates an inkjet head 100. Although not visible in FIG. 1, inkjet head 100 includes one or more rows of nozzles on a nozzle plate surface 102 that jet or eject droplets of liquid material, such as ink (e.g., water, solvent, oil, or UV-curable). Inkjet head 100 may comprise a single color, two color, or four color head. Inkjet head 100 includes integrated electronics 104 that connect to a data source through cabling 106.

Figure 2:
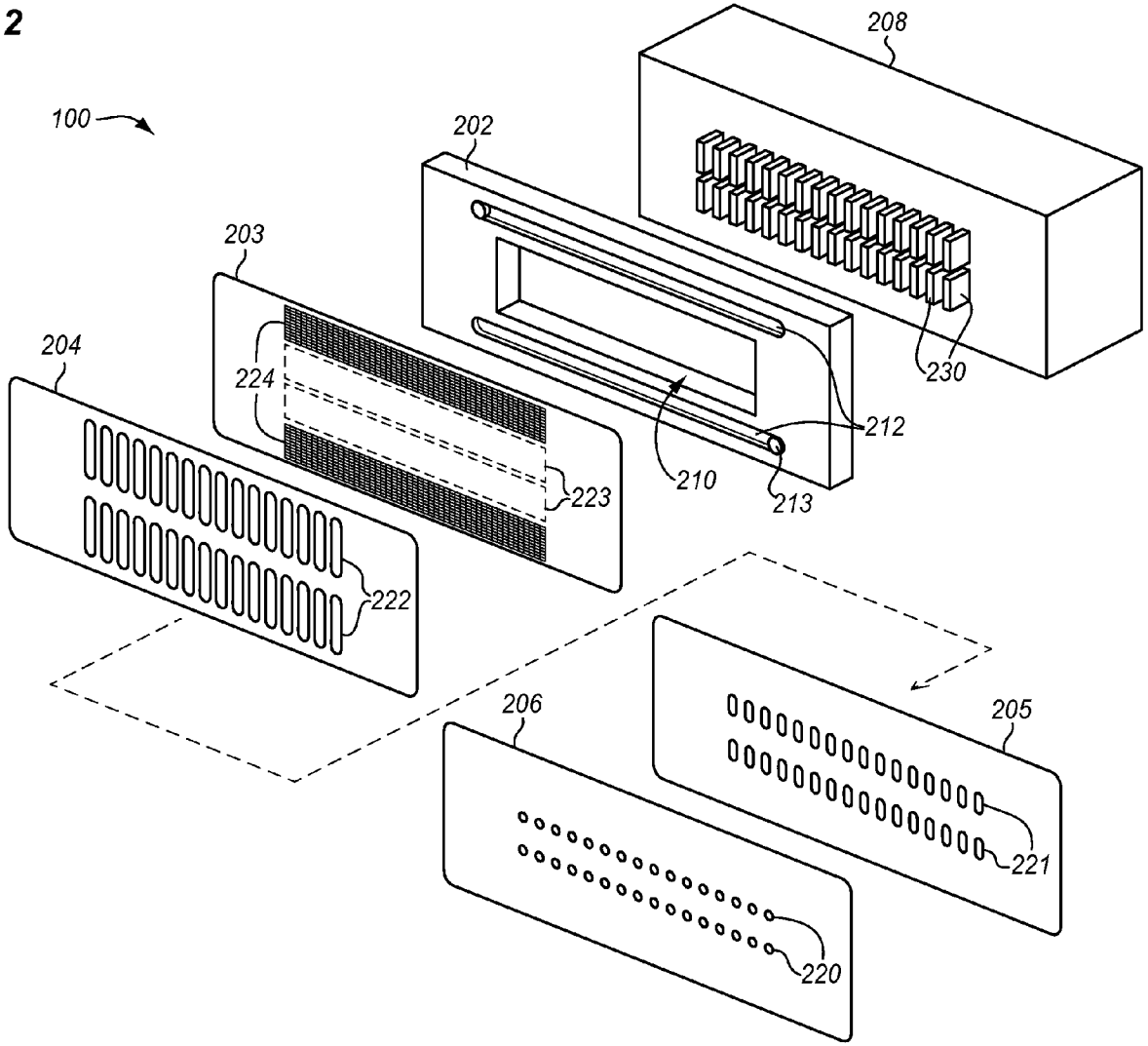
FIG. 2 illustrates an exploded, perspective view of an inkjet head.

FIG. 2 illustrates an exploded, perspective view of inkjet head 100. Inkjet head 100 forms a plurality of ink channels that are each capable of dispersing ink. Although the term "ink" is used herein, inkjet head 100 is capable of dispersing different types of liquid material used for printing. Each ink channel includes a nozzle, a chamber, and a mechanism for ejecting ink from the chamber and through the nozzle, which is typically a diaphragm and a piezoelectric actuator.

In this example, inkjet head 100 includes a housing 202, a series of plates 203-206, and a piezoelectric device 208. Housing 202 is a rigid member to which the plates 203-206 attach to form inkjet head 100. Housing 202 includes an opening 210 for piezoelectric device 208 to pass through and interface with a diaphragm plate 203. Housing 202 further includes one or more grooves 212 on a surface that faces plates 203-206 for supplying ink to the ink channels. Groove 212 includes one or more holes 213 that are in fluid communication with an ink reservoir.

The plates 203-206 of inkjet head 100 are fixed or bonded to one another to form a laminated plate structure, and the laminated plate structure is affixed to housing 202. The laminated plate structure includes the following plates: an orifice plate 206, one or more chamber plates 205, a restrictor plate 204, and diaphragm plate 203. Orifice plate 206 includes a plurality of nozzles 220 that are formed in one or more rows. Chamber plate 205 is formed with a plurality of chambers 221 that correspond with the nozzles 220 of orifice plate 206. The chambers 221 are each able to hold ink that is to be ejected out its corresponding nozzle 220. Restrictor plate 204 is formed with a plurality of restrictors 222. The restrictors 222 fluidly connect chambers 221 to the ink supply, and control the flow of ink into chambers 221. Diaphragm plate 203 is formed with diaphragms 223 and filter sections 224. Diaphragms 223 each comprise a sheet of a semi-flexible material that vibrates in response to actuation by piezoelectric device 208. Filter sections 224 remove foreign matter from ink entering into the ink channels.

Piezoelectric device 208 includes a plurality of piezoelectric actuators 230; one for each of the ink channels. The ends of piezoelectric actuators 230 contact diaphragms 223 in diaphragm plate 203. An external drive circuit (e.g., electronics 104) is able to selectively apply drive waveforms to piezoelectric actuators 230, which vibrate the diaphragm 223 for individual ink chambers. The vibration of diaphragms 223 causes ink to be ejected or jetted from its corresponding nozzle 220. Inkjet head 100 can therefore print desired patterns by selectively "activating" the ink channels to discharge ink out of their respective nozzles.

Figure 3:
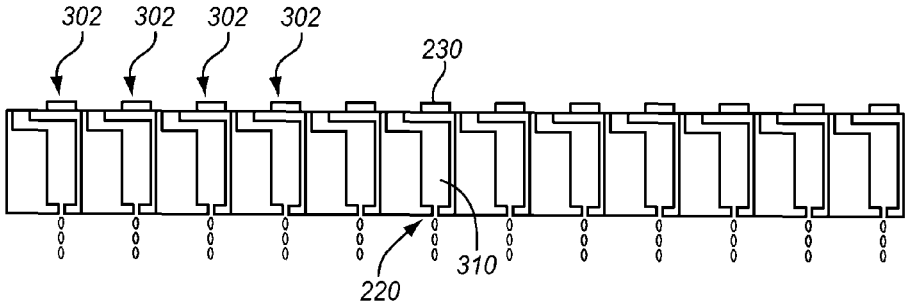
FIG. 3 is a cross-sectional view of a set of ink channels within an inkjet head.

FIG. 3 is a cross-sectional view of a set of ink channels 302 within inkjet head 100. Inkjet head 100 includes multiple ink channels 302 in parallel, a portion of which are illustrated in FIG. 3. Each ink channel 302 includes a piezoelectric actuator 230, a chamber 310, and a nozzle 220. Piezoelectric actuators 230 are configured to receive drive waveforms, and to actuate or "fire" in response to a jetting pulse on the drive waveform. Firing of a piezoelectric actuator 230 in an ink channel 302 creates pressure waves within the ink channel 302 that cause jetting of droplets from the nozzles 220.

Figure 4:
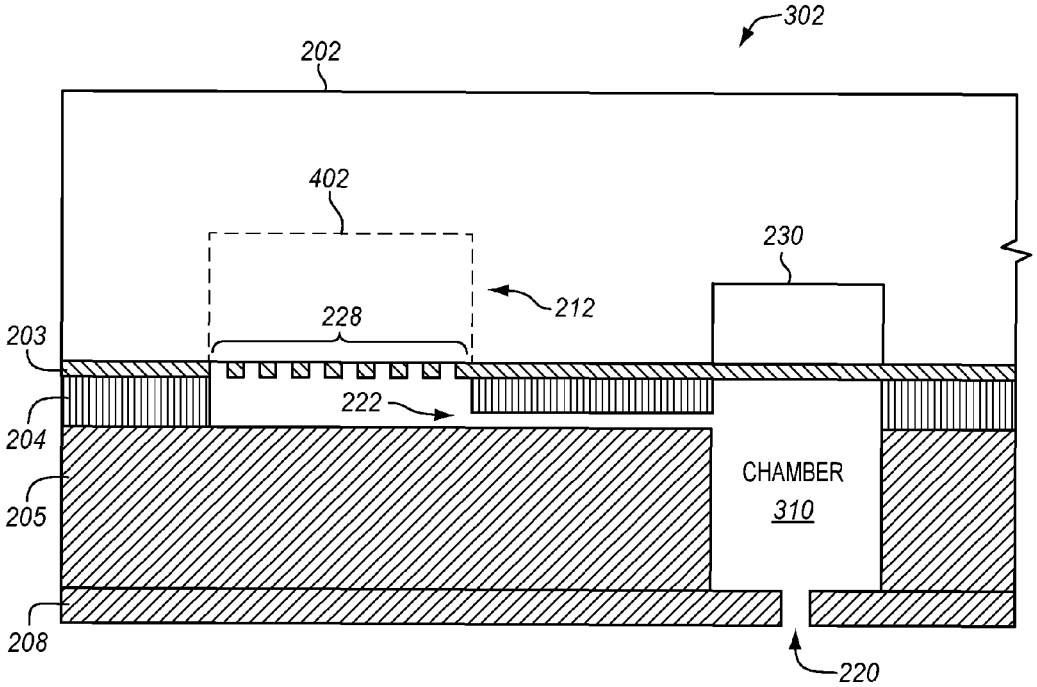
FIG. 4 is a cross-sectional view of an individual ink channel.

FIG. 4 is a cross-sectional view of an individual ink channel 302. The plate structure illustrated in FIG. 4 is intended to be an example of the basic structure of an ink channel 302. There may be additional plates that are used in the plate structure that are not shown in FIG. 4, and FIG. 4 is not necessarily drawn to scale. Diaphragm plate 203 is shown as being connected to housing 202. The filter section 228 of diaphragm plate 203 lines up with the supply manifold 402 formed by groove 212. Restrictor plate 204 is sandwiched between diaphragm plate 203 and chamber plate 205. Restrictor plate 204 includes restrictor 222 that controls a flow of ink from the supply manifold 402 to chamber 310. Chamber plate 205 forms the chamber 310 for the ink channel 302. Orifice plate 208 has the nozzle 220 for the ink channel 302.

Figure 5:
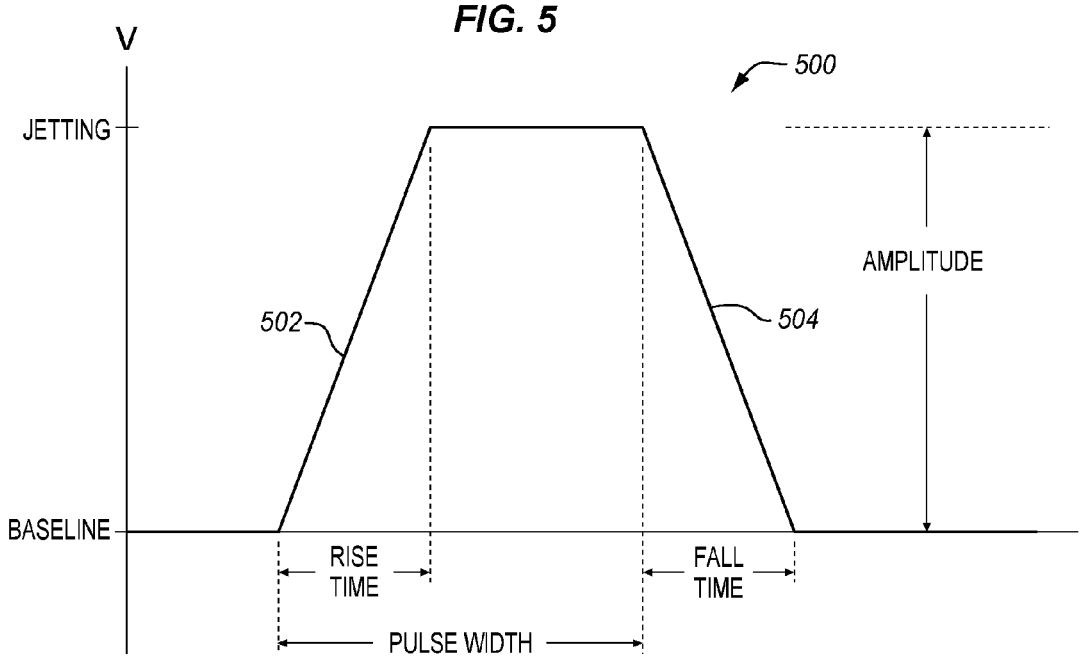
FIG. 5 illustrates a standard jetting pulse for an inkjet head.

Piezoelectric actuator 230 is the actuating device for ink channel 302 to jet a droplet. Piezoelectric actuator 230 converts electrical energy directly into linear motion. To jet from ink channel 302, a drive waveform is provided to piezoelectric actuator 230 with one or more jetting pulses. A jetting pulse causes a deformation, physical displacement, or stroke of piezoelectric actuator 230, which in turn acts to deform a wall of chamber 310. Deformation of the chamber wall generates pressure waves inside ink channel 302 that are able to jet a droplet from ink channel 302 (when specific conditions are met). A standard jetting pulse is therefore able to cause a droplet to be jetted from ink channel 302 with the desired properties when ink channel 302 is at rest. FIG. 5 illustrates a standard jetting pulse 500 for an inkjet head. Jetting pulse 500 may be characterized by the following parameters: rise time, fall time, pulse width, and amplitude. Jetting pulse 500 transitions from a baseline voltage to a target jetting voltage. The potential difference between the baseline and the target jetting voltage represents the amplitude of jetting pulse 500. These parameters of jetting pulse 500 can impact the jetting characteristics of the droplets from the inkjet head (e.g., droplet velocity and mass). For example, a target amplitude of jetting pulse 500 provides a droplet of a desired velocity and mass to be jetted from an ink channel. A standard jetting pulse 500 may be selected for different types of inkjet heads to produce droplets having a desired shape (e.g., spherical), size, velocity, etc.

The following provides an example of jetting a droplet from an ink channel using jetting pulse 500, such as from ink channel 302 in FIG. 4. The leading edge 502 (i.e., the first slope) of jetting pulse 500 causes a piezoelectric actuator to displace in a first direction, which enlarges the ink channel and generates negative pressure waves within the ink channel. The negative pressure waves propagate within the ink channel and are reflected by structural changes in the ink channel as positive pressure waves. The trailing edge 504 (i.e., the second slope) of jetting pulse 500 causes the piezoelectric actuator to displace in an opposite direction, which reduces the ink channel to its original size and generates another positive pressure wave. When the timing of the trailing edge 504 of jetting pulse 500 is appropriate, the positive pressure wave created by the piezoelectric actuator displacing to reduce the ink channel size will combine with the reflected positive pressure waves to form a combined wave that is large enough to cause a droplet to be jetted from the nozzle of the ink channel. Therefore, the positive pressure wave generated by the trailing edge of jetting pulse 500 acts to amplify the positive pressure waves that reflect within the ink channel due to the leading edge 502 of jetting pulse 500. The geometry of the ink channel and the drive waveform are designed to generate a large positive pressure peak at the nozzle, which drives the ink through the nozzle.

When ink channels 302 are fabricated close together as in FIG. 3, crosstalk between ink channels 302 may become an issue. For example, ink channels 302 may be only 100 microns apart. If the piezoelectric actuator 230 in one ink channel 302 fires (i.e., displaces or strokes) to jet ink from its corresponding nozzle 220, then the firing of the piezoelectric actuator 230 may create residual vibrations (both mechanical and fluidic) in neighboring ink channels 302. Crosstalk between ink channels 302 may create variations in the jetting characteristics of the ink channels 302. For example, crosstalk may cause the droplet mass or droplet velocity to be decreased from a normal case. The embodiments described below mitigate the effects of crosstalk in an inkjet head by altering the drive waveforms provided to the piezoelectric actuators 230.

Figure 6:
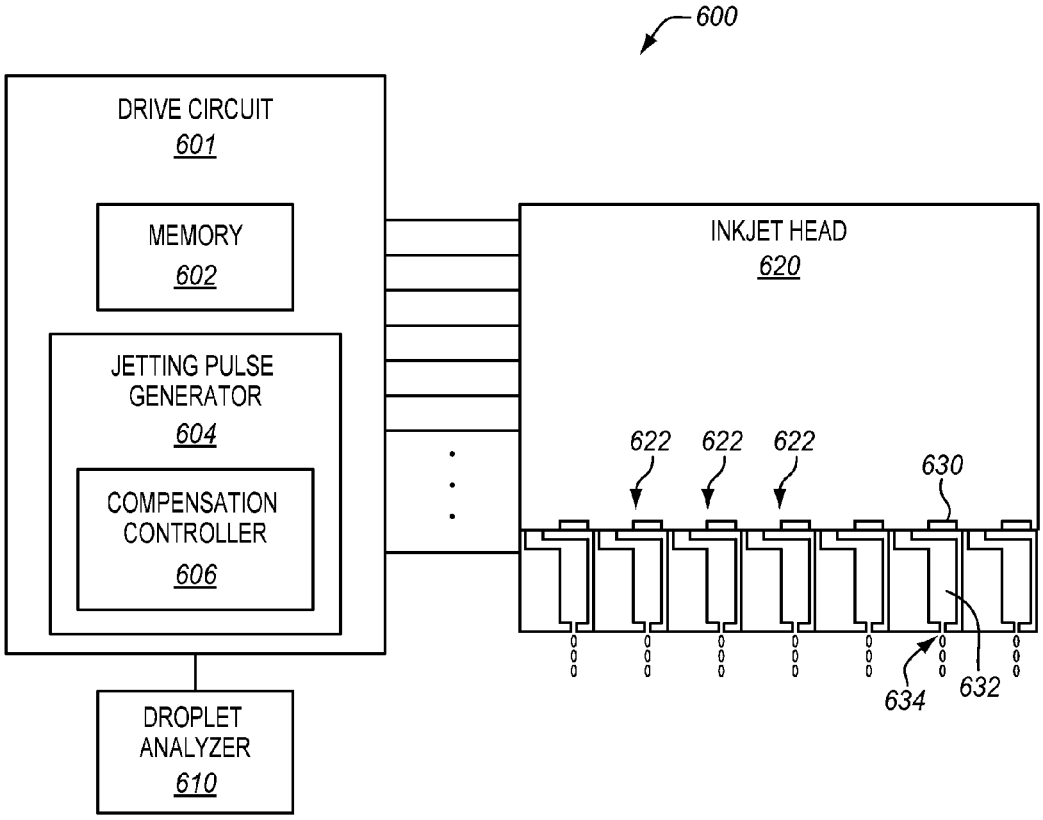
FIG. 6 illustrates an inkjet system in an exemplary embodiment.

FIG. 6 illustrates an inkjet system 600 in an exemplary embodiment. Inkjet system 600 includes a drive circuit 601 for providing waveforms to piezoelectric actuators of an inkjet head, such as inkjet head 620. Inkjet head 620 is illustrated as including a plurality of ink channels 622, with each ink channel 622 including a piezoelectric actuator 630, a chamber 632, and a nozzle 634. The representation of inkjet head 620 is just an example, as drive circuit 601 may connect to different types of inkjet heads. Inkjet head 620 may have a similar structure as shown for inkjet head 100 shown in FIGS. 1-4.

Drive circuit 601 includes a memory 602, a jetting pulse generator 604, and a compensation controller 606. Memory 602 comprises any device that stores data. Jetting pulse generator 604 comprises a circuit, firmware, or component that generates drive waveforms for piezoelectric actuators 630 of an inkjet head 620, where the drive waveforms include jetting pulses. A "jetting pulse" is defined as a pulse that causes a droplet to be jetted from an ink channel 622 with the desired properties. Jetting pulse generator 604 is configured to selectively provide the jetting pulses to ink channels 622 to discharge ink onto a medium. A medium described herein comprises any type of material upon which ink or another liquid is applied by an inkjet head for printing, such as paper, a substrate for 3D printing, cloth, etc.

Compensation controller 606 comprises a circuit, firmware, or component that adjusts, modifies, or changes a drive waveform for piezoelectric actuators of an inkjet head to compensate or mitigate for crosstalk between the ink channels in the inkjet head. Compensation controller 606 is able to modify the drive waveform output by jetting pulse generator 604. For example, compensation controller 606 may include one or more resistors that are added to or removed from a circuit of jetting pulse generator 604 to modify the drive waveform output by jetting pulse generator 604. Compensation controller 606 is able to change the shape of the drive waveform to mitigate for crosstalk in an inkjet head.

Inkjet system 600 may also include a droplet analyzer 610. Droplet analyzer 610 comprises a system that is able to identify crosstalk in an inkjet head based on the jetting characteristics of the droplets from the inkjet head. Droplet analyzer 610 may have different configurations in different embodiments. In one embodiment, droplet analyzer 610 may include a system that uses a visualization technique to analyze actual droplet jetting/ejection of an inkjet head. For example, a stroboscopic visualization technique may be used, which uses a high-resolution camera, a Laser Doppler Velocimetry (LDV) system, and a stroboscope to analyze droplet jetting from nozzles of an inkjet head. A visualization technique such as this may be used to measure the velocity and mass/volume of droplets that are jetted from nozzles of the ink channels. In another example, a modeling technique (e.g., Lumped Element Modeling (LEM)) may be used to simulate droplet jetting/ejection of an inkjet head. Droplet analyzer 610 is able to evaluate the actual performance of an inkjet head or model the performance of an inkjet head to identify crosstalk that exists or may exist within the head.

Figure 7:
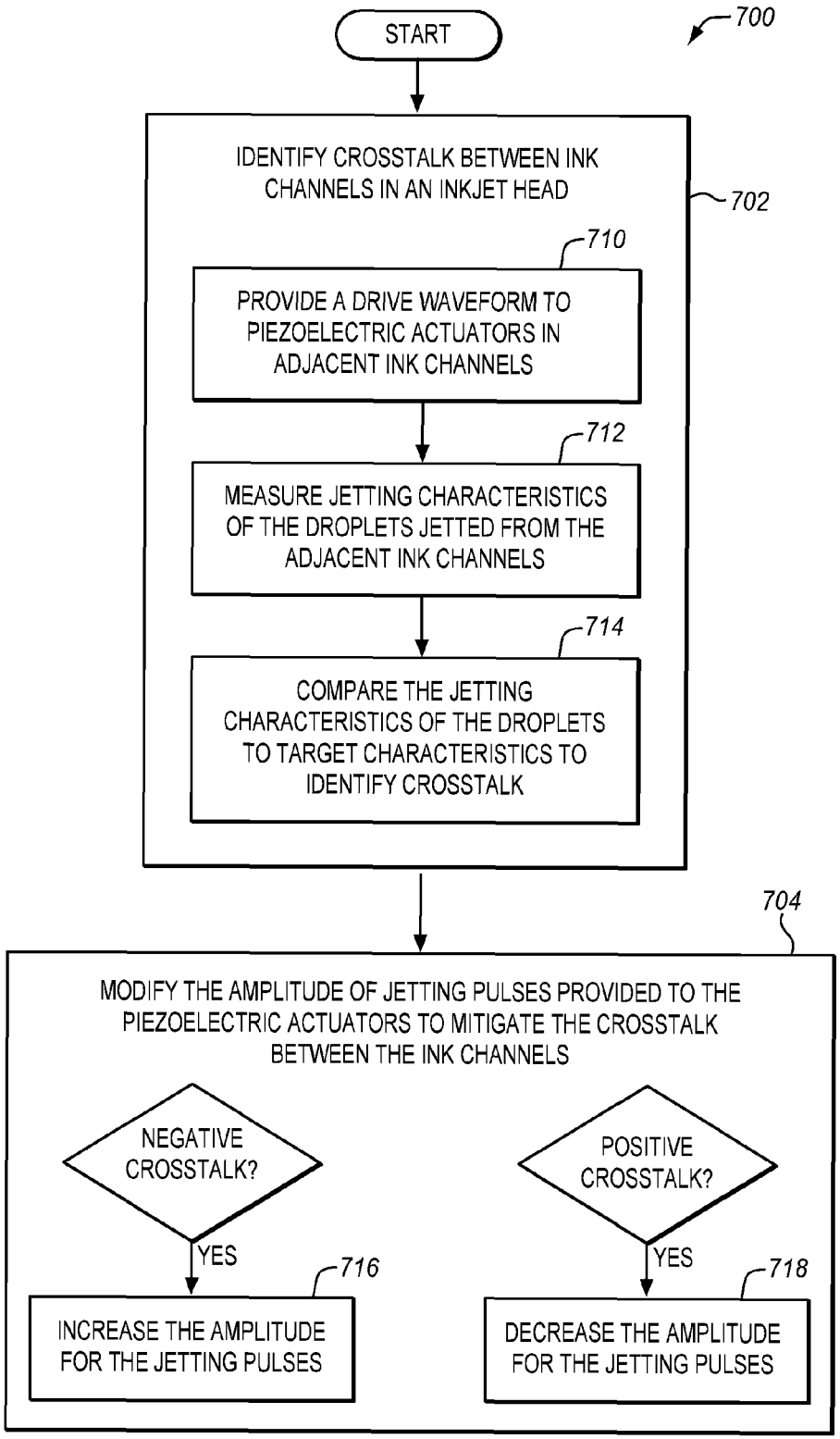
FIG. 7 is a flow chart illustrating a method of mitigating the effects of crosstalk in an inkjet head in an exemplary embodiment.

FIG. 7 is a flow chart illustrating a method 700 of mitigating the effects of crosstalk in an inkjet head in an exemplary embodiment. The steps of method 700 will be described with respect to inkjet system 600 in FIG. 6, although one skilled in the art will understand that the methods described herein may be performed by other devices or systems not shown. The steps of the methods described herein are not all inclusive and may include other steps not shown.

To begin, compensation controller 606 identifies crosstalk in inkjet head 620 (step 702). The step of "identifying" crosstalk in an inkjet head may be performed in a variety of ways. In one embodiment, a crosstalk value may be preprovisioned in memory 602 indicating the type of crosstalk (e.g., negative or positive) that occurs in inkjet head 620. Compensation controller 606 may access memory 602, when connected to inkjet head 620, to identify the type of crosstalk that occurs within inkjet head 620.

In another embodiment, compensation controller 606 may actively identify the type of crosstalk that occurs within inkjet head 620 using droplet analyzer 610. To do so, droplet analyzer 610 may measure jetting characteristics of droplets from inkjet head 620 in response to a drive waveform. Drive circuit 601 provides a drive waveform to piezoelectric actuators 630 in adjacent ink channels 622 (step 710), measures jetting characteristics of the droplets jetted from the adjacent ink channels 622 (step 712), and compares the jetting characteristics of the droplets to target characteristics to identify crosstalk for inkjet head 620 (step 714). As an example, assume that inkjet head 620 has 192 ink channels in parallel. Drive circuit 601 may send a drive waveform to fire the piezoelectric actuator 630 in ink channel 1. Droplet analyzer 610 measures the jetting characteristics of the droplets discharged from ink channel 1, and compares the jetting characteristics of the droplets to target characteristics (e.g., jetting characteristics with no crosstalk or jetting characteristics expected from the inkjet head). Drive circuit 601 may then send a drive waveform to fire the piezoelectric actuators 630 in ink channels 1-2. Droplet analyzer 610 measures the jetting characteristics of the droplets discharged from ink channels 1-2, and compares the jetting characteristics of the droplets to target characteristics. Drive circuit 601 may then send a drive waveform to fire the piezoelectric actuators 630 in ink channels 1-3. Droplet analyzer 610 measures the jetting characteristics of the droplets discharged from ink channels 1-3, and compares the jetting characteristics of the droplets to target characteristics. This process may continue until a sufficient number of adjacent ink channels are fired to identify crosstalk (e.g., all 192 channels firing at the same time). Droplet analyzer 610 can measure the jetting characteristics of inkjet head 620 during the firing of adjacent ink channels 622, and plot the jetting characteristics as a percentage of the target characteristics.

Figure 8:
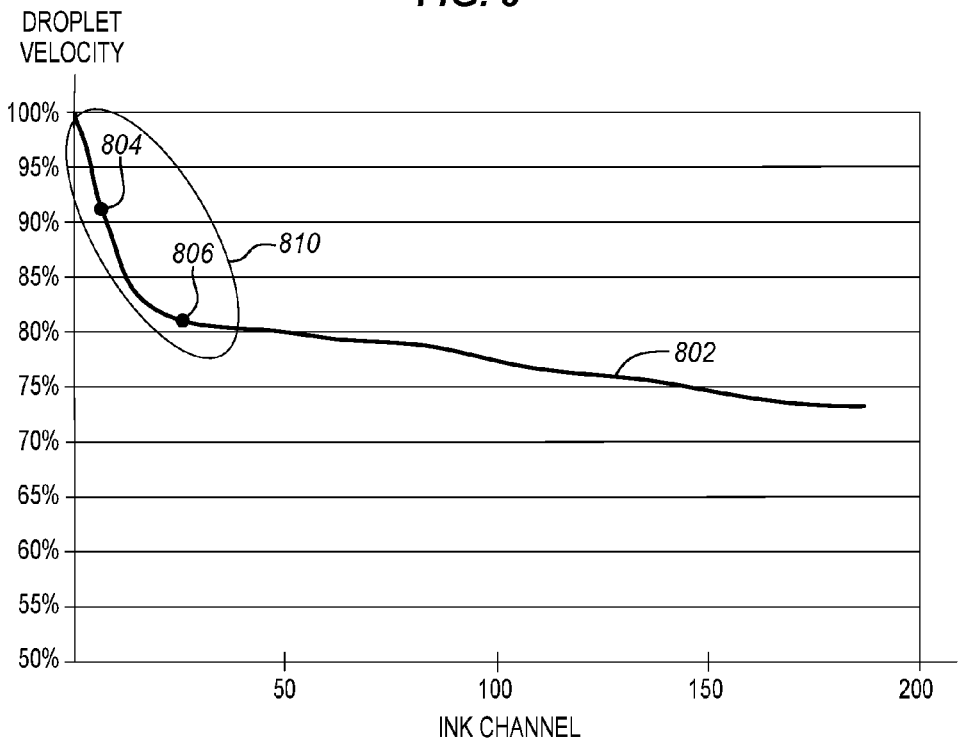
FIG. 8 illustrates jetting characteristics of an inkjet head indicating negative crosstalk in an exemplary embodiment.

FIG. 8 illustrates jetting characteristics of an inkjet head indicating negative crosstalk in an exemplary embodiment. The vertical axis in FIG. 8 represents the velocity of droplets measured from inkjet head 620 as a percentage of a target velocity, and the horizontal axis in FIG. 8 represents the ink channels 622 in inkjet head 620. Line 802 represents the droplet velocity percentage as piezoelectric actuators 630 are firing to jet droplets from ink channels 622. For example, on the left hand side of FIG. 8, when only one ink channel is jetting, the droplet velocity is at about 100% of the target velocity. When 10 adjacent ink channels 622 are jetting (point 804), the droplet velocity drops down to about 91%. When 25 adjacent ink channels 622 are jetting (point 806), the droplet velocity drops down to about 81%. As is evident from the graph in FIG. 8, as more adjacent ink channel 622 are jetting in inkjet head 620 due to firing of piezoelectric actuators 630, the droplet velocity declines. One reason for the reduction in droplet velocity is crosstalk (mechanical and fluidic) between the ink channels 622. The steep decline in droplet velocity shown in area 810 of FIG. 8 indicates the crosstalk in inkjet head 620. Because the droplet velocity drops as adjacent ink channels 622 are jetting, this inkjet head 620 would be characterized as having "negative crosstalk". Negative crosstalk is a type of crosstalk that reduces the jetting characteristics of ink channels (e.g., velocity, mass, etc.).

Figure 9:
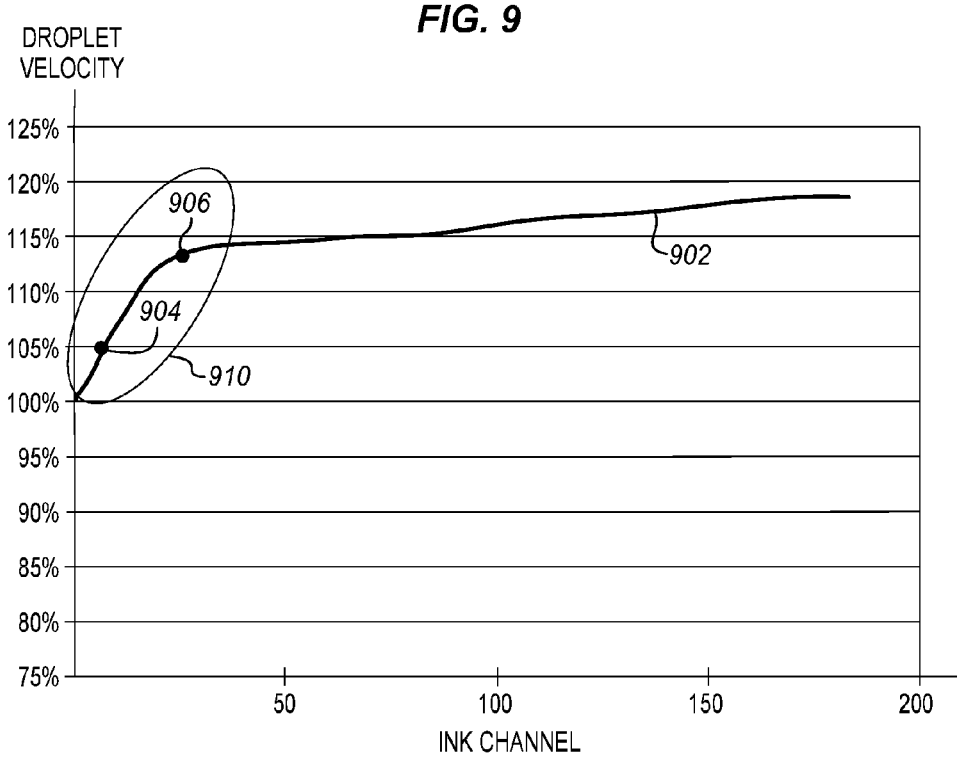
FIG. 9 illustrates jetting characteristics of an inkjet head indicating positive crosstalk in another exemplary embodiment.

An inkjet head may also have "positive crosstalk". Positive crosstalk is a type of crosstalk that increases the jetting characteristics of ink channels. FIG. 9 illustrates jetting characteristics of an inkjet head indicating positive crosstalk in another exemplary embodiment. Line 902 again represents the droplet velocity as piezoelectric actuators 630 are firing to jet droplets from ink channels 622. On the left hand side of FIG. 9, when only one ink channel 622 is jetting, the droplet velocity is at about 100% of the target velocity. When 10 adjacent ink channels are jetting (point 904), the droplet velocity increases to about 105%. When 25 adjacent ink channels are jetting (point 906), the droplet velocity increases to about 113%. As is evident from the graph in FIG. 9, as more adjacent ink channel are jetting in inkjet head 620 due to firing of piezoelectric actuators 630, the droplet velocity increases. One reason for the increase in droplet velocity is crosstalk between the ink channels 622. The steep incline in droplet velocity shown in area 910 of FIG. 9 indicates the positive crosstalk in inkjet head 620.

When compensation controller 606 identifies crosstalk in inkjet head 620 (step 702 of FIG. 7), an entry may be stored in memory 602. For example, the entry may include an identifier for inkjet head 620, and a crosstalk value indicating the type of crosstalk identified for inkjet head 620. Other modules may access memory 602 to identify the type of crosstalk that occurs within inkjet head 620.

Figure 10:
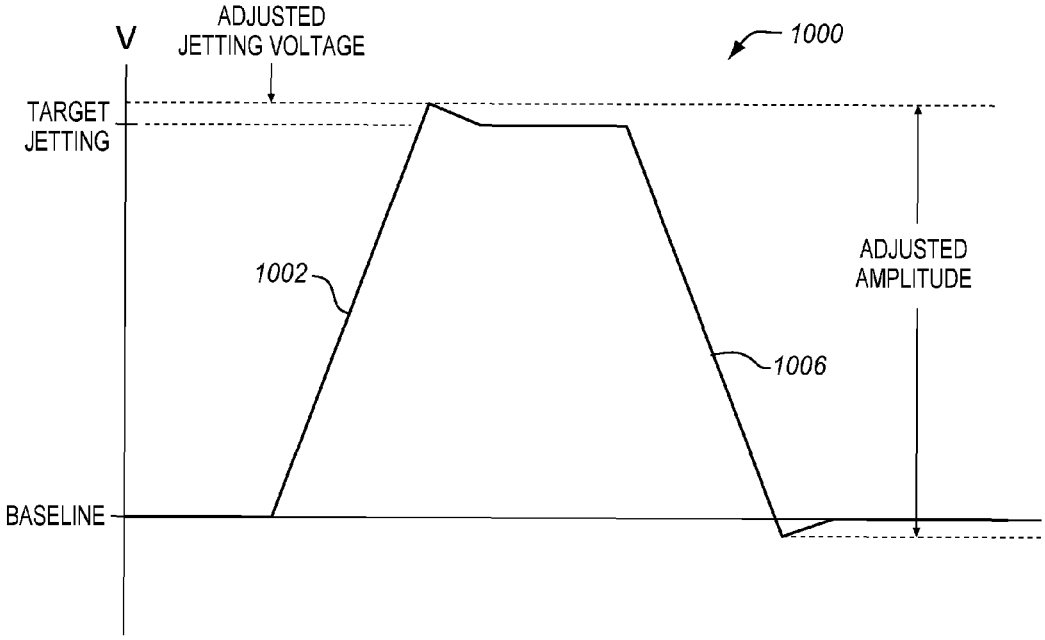
FIG. 10 illustrates a modified drive waveform for an inkjet head in an exemplary embodiment.

To mitigate the effects of crosstalk in inkjet head 620, compensation controller 606 modifies, changes, or alters the amplitude of the jetting pulses provided to the ink channels 622 (step 704). If inkjet head 620 has negative crosstalk between the ink channels 622, then compensation controller 606 increases the amplitude of the jetting pulses (step 716). FIG. 10 illustrates a modified drive waveform 1000 for an inkjet head in an exemplary embodiment. The target jetting voltage in FIG. 10 represents the voltage that provides desired jetting characteristics under normal operating conditions. When negative crosstalk exists in inkjet head 620, compensation controller 606 will increase the amplitude of the jetting pulse by adjusting the jetting voltage of the pulse. To increase the amplitude of the jetting pulse in FIG. 10, compensation controller 606 may drive the leading edge 1002 of the jetting pulse to an adjusted jetting voltage that exceeds the target jetting voltage. The transition between the baseline voltage and the adjusted jetting voltage on leading edge 1002 is greater than the transition between the baseline voltage and the target jetting voltage to increase the amplitude of the jetting pulse. For example, if the target jetting voltage is 14 V, then the jetting pulse may be driven to an adjusted jetting voltage of 15 V on leading edge 1002. The jetting pulse is illustrated in FIG. 10 as "overshooting" the target jetting voltage on leading edge 1002, which means it exceeds the target jetting voltage either temporarily or for the entire width of the jetting pulse.

If the jetting pulse settles on the target jetting voltage as shown in FIG. 10 (after temporarily overshooting the target jetting voltage), then compensation controller 606 may drive the trailing edge 1006 of the jetting pulse below the baseline voltage. For example, if the baseline voltage is 0 V, then the jetting pulse may be driven to −1 V on trailing edge 1006. The jetting pulse may settle at a steady-state on the baseline voltage after being driven below the baseline voltage. The modified jetting pulse as in FIG. 10 will have a higher overall amplitude than a normal jetting pulse, which provides more energy to the piezoelectric actuator. This in turn causes the piezoelectric actuator to fire a droplet at a higher velocity. The faster jetting of a droplet by one or more piezoelectric actuators helps to mitigate the effects of negative crosstalk.

Figure 11:
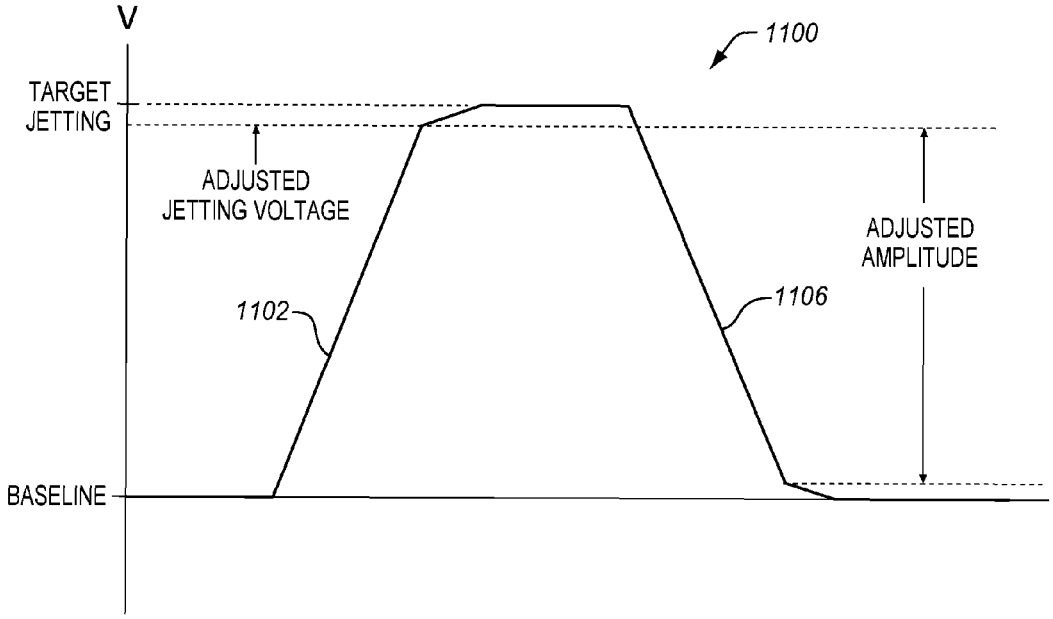
FIG. 11 illustrates a modified drive waveform for an inkjet head in an exemplary embodiment.

In FIG. 7, if inkjet head 620 has positive crosstalk between the ink channels 622, then compensation controller 606 decreases the amplitude of the jetting pulses (step 718 in FIG. 7). FIG. 11 illustrates a modified drive waveform 1100 for an inkjet head in an exemplary embodiment. The target jetting voltage in FIG. 11 represents the voltage that provides desired jetting characteristics under normal operating conditions. When positive crosstalk exists in inkjet head 620, compensation controller 606 will decrease the amplitude of the jetting pulse by adjusting the jetting voltage of the pulse. To decrease the amplitude of the jetting pulse in FIG. 11, compensation controller 606 may drive the leading edge 1102 of the jetting pulse to an adjusted jetting voltage that is below the target jetting voltage. The transition between the baseline voltage and the adjusted jetting voltage on leading edge 1102 is less than the transition between the baseline voltage and the target jetting voltage to decrease the amplitude of the jetting pulse. For example, if the target jetting voltage is 14 V, then the jetting pulse may be driven to an adjusted jetting voltage of 13 V on leading edge 1102. The jetting pulse is illustrated in FIG. 11 as "undershooting" the target jetting voltage on leading edge 1102, which means it fails to reach the target jetting voltage either temporarily or for the entire width of the jetting pulse.

If the jetting pulse settles on the target jetting voltage as shown in FIG. 11 (after temporarily undershooting the target jetting voltage), then compensation controller 606 may drive the trailing edge 1106 of the jetting pulse to fall short of the baseline voltage. For example, if the baseline voltage is 0 V, then the jetting pulse may be driven to 1 V on trailing edge 1106. The jetting pulse may settle at a steady-state on the baseline voltage after initially being driven above the baseline voltage. The modified jetting pulse as in FIG. 11 will have a lower overall amplitude than a normal jetting pulse, which provides less energy to the piezoelectric actuator. This in turn causes the piezoelectric actuator to fire a droplet at a lower velocity. The slower jetting of a droplet by one or more piezoelectric actuators helps to mitigate the effects of positive crosstalk.

The waveforms shown in FIGS. 10-11 may be inverted depending on the configuration of the inkjet head. The concepts described above also apply to inverted waveforms.

Any of the various components shown in the figures or described herein may be implemented as hardware, software, firmware, or some combination of these. For example, a component may be implemented as dedicated hardware. Dedicated hardware elements may be referred to as "processors", "controllers", or some similar terminology. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, a network processor, application specific integrated circuit (ASIC) or other circuitry, field programmable gate array (FPGA), read only memory (ROM) for storing software, random access memory (RAM), non-volatile storage, logic, or some other physical hardware component or module.

Also, a component may be implemented as instructions executable by a processor or a computer to perform the functions of the component. Some examples of instructions are software, program code, and firmware. The instructions are operational when executed by the processor to direct the processor to perform the functions of the element. The instructions may be stored on storage devices that are readable by the processor. Some examples of the storage devices are digital or solid-state memories, magnetic storage media such as a magnetic disks and magnetic tapes, hard drives, or optically readable digital data storage media.

Although specific embodiments were described herein, the scope of the invention is not limited to those specific embodiments. The scope of the invention is defined by the following claims and any equivalents thereof.

We claim:

1. A system comprising:

an inkjet head comprising a plurality of ink channels in a row that jet droplets of a liquid material onto a medium using piezoelectric actuators;

a jetting pulse generator that selectively provides drive waveforms to the piezoelectric actuators in the row, wherein the drive waveforms include jetting pulses that cause activation of the piezoelectric actuators to jet the droplets from the ink channels; and a compensation controller that identifies a crosstalk value indicating a type of crosstalk between the ink channels in the row for the inkjet head, and modifies the drive waveforms output by the jetting pulse generator and selectively provided to the piezoelectric actuators to increase an amplitude of each of the jetting pulses or decrease the amplitude of each of the jetting pulses based on the type of crosstalk.

2. The system of claim 1 wherein:

the compensation controller increases the amplitude of each of the jetting pulses responsive to negative crosstalk between the ink channels.

3. The system of claim 2 wherein:

the compensation controller adjusts a leading edge of the jetting pulses to exceed a target jetting voltage.

4. The system of claim 1 wherein:

the compensation controller decreases the amplitude of each of the jetting pulses responsive to positive crosstalk between the ink channels.

5. The system of claim 4 wherein:

the compensation controller adjusts a leading edge of the jetting pulses below a target jetting voltage.

6. The system of claim 1 further comprising:

a droplet analyzer;

the jetting pulse generator provides the drive waveforms to the piezoelectric actuators in adjacent ink channels; and the droplet analyzer measures jetting characteristics of the droplets jetted from the adjacent ink channels, and compares the jetting characteristics of the droplets to target characteristics to identify the type of crosstalk.

7. The system of claim 6 wherein:

the jetting characteristics comprise a velocity of the droplets.

8. The system of claim 6 wherein:

the jetting characteristics comprise a mass of the droplets.

9. A method of mitigating crosstalk in an inkjet head, wherein the inkjet head includes a plurality of ink channels in a row that jet droplets of a liquid material onto a medium using piezoelectric actuators, the method comprising:

selectively providing drive waveforms to the piezoelectric actuators in the row with a jetting pulse generator, wherein the drive waveforms include jetting pulses that cause activation of the piezoelectric actuators to jet the droplets from the ink channels;

identifying a crosstalk value indicating a type of crosstalk between the ink channels in the row for the inkjet head; and modifying the drive waveforms output by the jetting pulse generator and selectively provided to the piezoelectric actuators to increase an amplitude of each of the jetting pulses or decrease the amplitude of each of the jetting pulses based on the type of crosstalk.

10. The method of claim 9 wherein modifying the drive waveforms comprises:

increasing the amplitude of each of the jetting pulses responsive to negative crosstalk between the ink channels.

11. The method of claim 10 wherein increasing the amplitude of the jetting pulses comprises:

adjusting a leading edge of the jetting pulses to exceed a target jetting voltage.

12. The method of claim 9 wherein modifying the drive waveforms comprises:

decreasing the amplitude of each of the jetting pulses responsive to positive crosstalk between the ink channels.

13. The method of claim 12 wherein decreasing the amplitude of the jetting pulses comprises:

adjusting a leading edge of the jetting pulses below a target jetting voltage.

14. The method of claim 9 further comprising:

identifying the crosstalk between the ink channels in the inkjet head by:

providing the drive waveforms to the piezoelectric actuators in adjacent ink channels;

measuring jetting characteristics of the droplets jetted from the adjacent ink channels; and comparing the jetting characteristics of the droplets to target characteristics to identify the type of crosstalk.

15. The method of claim 14 wherein:

the jetting characteristics comprise a velocity of the droplets.

16. The method of claim 14 wherein:

the jetting characteristics comprise a mass of the droplets.

17. A system comprising:

a drive circuit that connects to an inkjet head having ink channels in a row that jet droplets of a liquid material onto a medium using piezoelectric actuators;

the drive circuit selectively provides drive waveforms to the piezoelectric actuators, wherein the drive waveforms include jetting pulses that cause activation of the piezoelectric actuators to jet the droplets from the ink channels; and the drive circuit identifies a crosstalk value indicating a type of crosstalk between the ink channels in the row for the inkjet head, and modifies the drive waveforms selectively provided to the piezoelectric actuators to increase an amplitude of each of the jetting pulses or decrease the amplitude of each of the jetting pulses based on the type of crosstalk.

18. The system of claim 17 wherein:

the drive circuit increases the amplitude of the jetting pulses responsive to negative crosstalk between the ink channels.

19. The system of claim 17 wherein:

the drive circuit decreases the amplitude of the jetting pulses responsive to positive crosstalk between the ink channels.

* * * * *